US011408708B2

(12) United States Patent
Brown

(10) Patent No.: US 11,408,708 B2
(45) Date of Patent: Aug. 9, 2022

(54) COMPOUND HIGH EFFICIENCY RIFLE SLING

(71) Applicant: Matthew Caleb Brown, Alliance, OH (US)

(72) Inventor: Matthew Caleb Brown, Alliance, OH (US)

( * ) Notice: Subject to any disclaimer, the term of this patent is extended or adjusted under 35 U.S.C. 154(b) by 0 days.

(21) Appl. No.: 16/799,452

(22) Filed: Feb. 24, 2020

(65) Prior Publication Data

US 2020/0224999 A1 Jul. 16, 2020

Related U.S. Application Data

(60) Provisional application No. 62/793,290, filed on Jan. 16, 2019.

(51) Int. Cl.
*F41C 33/02* (2006.01)
*F41C 33/00* (2006.01)
*F41C 23/02* (2006.01)

(52) U.S. Cl.
CPC ..... *F41C 33/002* (2013.01); *F41C 23/02* (2013.01)

(58) Field of Classification Search
CPC ..... F41C 33/002; F41C 33/001; F41C 23/02; Y10S 224/913
See application file for complete search history.

(56) References Cited

U.S. PATENT DOCUMENTS

| | | | | |
|---|---|---|---|---|
| 3,441,185 | A * | 4/1969 | Moomaw | F41C 33/002 224/150 |
| 4,511,070 | A * | 4/1985 | Hightower | F41C 23/02 224/150 |
| 6,932,254 | B2 * | 8/2005 | Eliason | A45F 3/14 150/108 |
| 7,988,023 | B1 * | 8/2011 | Nykoluk | F41C 33/002 224/150 |
| 9,157,700 | B1 * | 10/2015 | Hansen | F41C 33/002 |
| 9,746,284 | B2 * | 8/2017 | McCarthy | F41C 33/002 |
| 2014/0203053 | A1 * | 7/2014 | Rivas-Schlanger | F41C 23/02 224/150 |
| 2016/0265873 | A1 * | 9/2016 | Schuman | F41C 33/002 |
| 2017/0191793 | A1 * | 7/2017 | McLean | F41C 23/02 |
| 2017/0205192 | A1 * | 7/2017 | Weimer | F41C 33/002 |
| 2019/0025013 | A1 * | 1/2019 | Lance | F41C 23/02 |

* cited by examiner

*Primary Examiner* — Corey N Skurdal

(57) ABSTRACT

A sling that can be attached to any rifle, long gun or case, with a single main section of webbing running the entire length of the sling, routed through a linearly moveable quick release buckle, then looped through an oval ring fixed to one end of the sling, back through another oval ring attached to the quick release buckle and back towards the fixed oval ring to form a compound S-shaped adjustment loop with three layers of webbing, laying one on top of the other, giving the sling additional length when expanded, while also enabling it to be fully retracted. The quick release buckle can linearly move along the full length of the sling with the quick and easy manipulation of the buckle.

1 Claim, 1 Drawing Sheet

COMPOUND HIGH EFFICIENCY RIFLE SLING

BACKGROUND OF THE INVENTION

Field of the Invention

The invention pertains to the field of firearms and the means, methods, systems, and apparatus intended to support a firearm from a person, commonly referred to as slings.

Prior Art

Most slings and other systems for supporting a firearm are either simple straps with limited adjustment or are overly complicated. Some slings may have an adjustment loop with a friction slider. This slider can be difficult to adjust quickly or in a natural motion while shouldering the firearm. The adjustment loop itself still does not have sufficient length of adjustment, when the firearm is slung around a person's shoulder. The firearm cannot be pulled tight against a person's body. Furthermore, most slings are attached and hang from a firearm at their relative full length. This can pose a dangerous snag hazard for law enforcement and military personnel accessing the firearm from a vehicle.

BRIEF SUMMARY OF THE INVENTION

The present invention, referred to as a sling, corrects the shortcomings in the prior art. The sling is comprised of a single main section of webbing running the entire length of the sling, routed through a quick release buckle and a set of oval rings to form three separate layers in a S-shaped adjustment loop, giving the sling greater overall length when fully expanded. When collapsed, the excess webbing routes through the adjustment loop forming the three layers, laying one on top of the other. The sling can be easily adjusted to fit tightly against a firearm to drastically reduce any snag hazard. The quick release buckle can be easily manipulated and used to adjust the length of the sling and prevent the sling from opening further than where the quick release buckle is positioned on the sling.

DETAILED DESCRIPTION OF THE INVENTION

Figure 1:
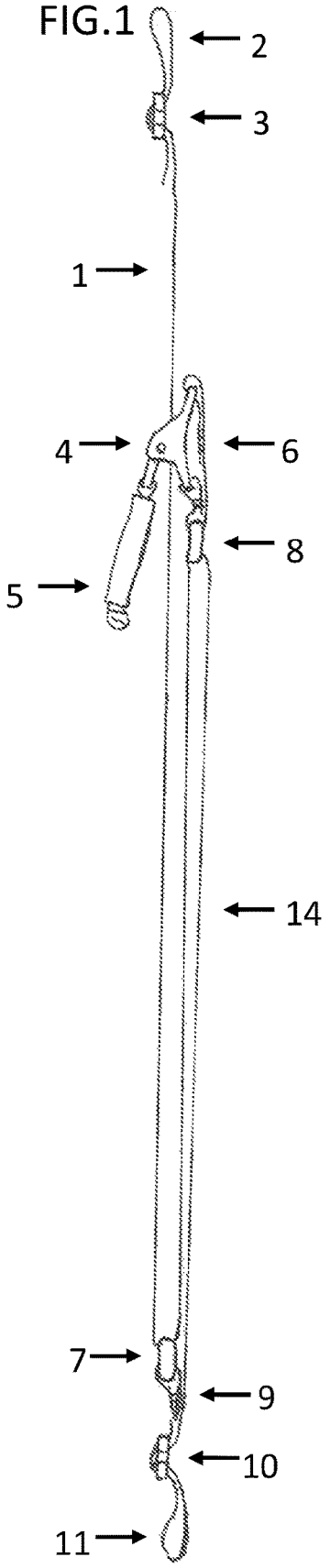
FIG. 1 is a side view of the sling assembly.
Figure 3:
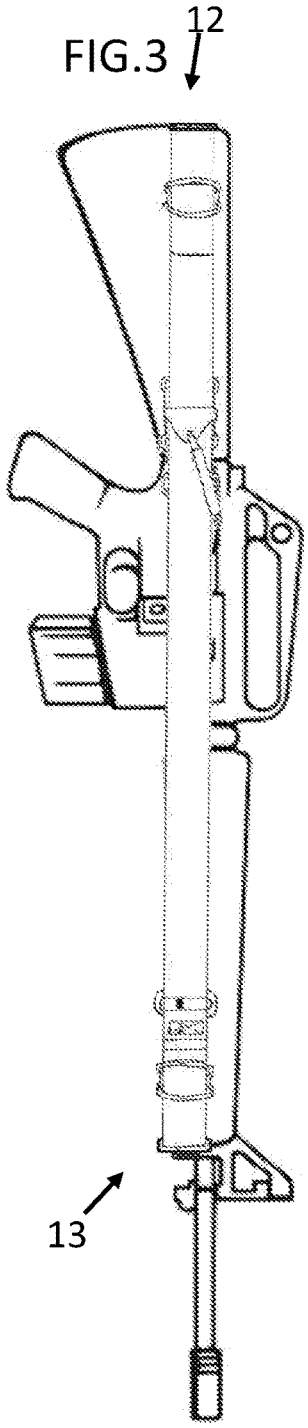
FIG. 3 is a front view of the sling assembly attached to the side of a rifle.
Figure 2:
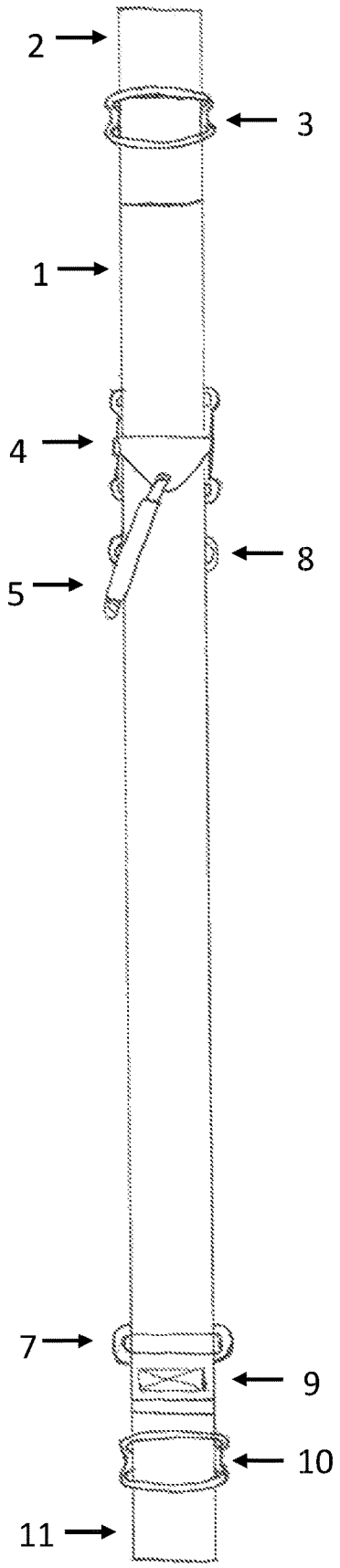
FIG. 2 is a front view of the sling assembly.

The compound apparatus, referred to as a sling in this description, can be attached to any number of implements including long guns, rifles, shotguns, machine guns, submachine guns, military weapons, law enforcement weapons, tactical weapons, hunting weapons, as well as cases and other implements.

The sling starts at the rifle's buttstock 12 fastened by a loop 2 of one end of the sling webbing 1 folded back through and secured by a "tri-glide" slide 3. The loop can be fastened to the rifle by several methods, means and devices including, but not limited to, a sling swivel, mash hook, welded D-ring, etc. Sling webbing 1 continues towards the muzzle end of the rifle 13 passing through a quick release buckle 4 with a handle 5 at the proximate center third of the sling. The webbing then passes through an oval ring 7 and loops back towards the buttstock end of the rifle 12 where it passes through a second oval ring 8 which is fastened to the quick release buckle with a short section of webbing 6. From there the main section of webbing loops back towards the muzzle end of the rifle 13 passing underneath the first oval ring 7, which is then secured to the main section of webbing with a short section of webbing 9 at the proximate front of the sling. The main section of webbing then continues to the muzzle end of the rifle 13 where it loops back through another "triglide" slide 10 to form a loop 11 that can be fastened to the rifle by several methods, means and devices including, but not limited to, a sling swivel, mash hook, welded Dring, etc.

The main webbing section 1 that passes through the quick release buckle 4 then back and forth through the oval rings 7 & 8 forms a S-shaped adjustment loop 14 made up of three separate layers of webbing laying one on top of the other, which permits roughly three times the material in the same linear space when the sling is drawn tight against the rifle. When the quick release buckle 4 is actuated, the webbing is free to pass through it, allowing all three separate layer folds to be drawn out to the sling's maximum length, as the quick release buckle 4 is drawn along the length of the webbing towards the muzzle end of the rifle 13. To collapse the sling, the quick release buckle 4 is simply pulled back along the length of the webbing towards the buttstock of the rifle 12 until all of the webbing material 1 is drawn up tight in the folds between the two oval rings 7 & 8. The quick release buckle 4 can be positioned anywhere along the length of the webbing, giving unlimited adjustment between the minimum and maximum overall length of the sling.

When the quick release buckle 4 is pulled towards the buttstock end of the rifle 12, the webbing is drawn tight against the side of the rifle. This eliminates most snag hazards a law enforcement or military user would encounter when accessing the rifle from a vehicle or aircraft. To don the sling, the user actuates the quick release buckle 4 and expands the sling and then places the sling around the neck and shoulders in any number of traditional sling positions. The sling can then be adjusted to any desired length with the rifle shouldered. When the rifle is slung, the quick release buckle 4 can be pulled up towards the buttstock end of the rifle 12, drawing the sling and rifle tight against the user's body. The user is then free to perform any number of tasks with both hands without the rifle swinging and getting snagged. The rifle can be quickly shouldered by actuating the quick release buckle 4 and pushing it in a natural forward motion along the length of the webbing towards the muzzle end of the rifle 13, expanding the sling while simultaneously shouldering the rifle.

The claimed invention is:

1. A sling system comprising:

a single main section of webbing; a quick release buckle attached to a short section of webbing attached to an oval ring; a second oval ring attached to the main webbing section; a three-layer adjustment loop formed from the main section of webbing running through the quick release buckle, through the first oval ring, reversing back to the second oval ring, passing through the second oval ring and reversing again and passing under the first oval ring; an attachment point comprising a folded loop of the main webbing secured by friction sliders at both ends of the sling.

* * * * *